US005944436A

United States Patent [19]

Huang

[11] Patent Number: 5,944,436

[45] Date of Patent: Aug. 31, 1999

[54] PEN POSSIBLE TO SOUND

[75] Inventor: Tu-Tan Huang, Tainan, Taiwan

[73] Assignee: Hau Mei Industrial Co., Ltd., Tainan, Taiwan

[21] Appl. No.: 09/056,693

[22] Filed: Apr. 8, 1998

[51] Int. Cl.[6] ..... B43K 24/02; B43K 29/00

[52] U.S. Cl. ..... 401/109; 401/99; 401/195; 446/81

[58] Field of Search ..... 401/195, 52, 113, 401/114, 109, 110, 111, 112, 82, 99, 149; 446/81, 297, 404, 420, 418

[56] References Cited

U.S. PATENT DOCUMENTS

| | | | |
|---|---|---|---|
| 3,064,389 | 11/1962 | Lemelson | 446/420 |
| 3,268,939 | 8/1966 | Aversa | 401/109 X |
| 3,432,244 | 3/1969 | Bross | 401/113 |
| 3,448,541 | 6/1969 | Barlow | 446/81 |
| 4,968,168 | 11/1990 | Chern | 401/52 |
| 5,184,908 | 2/1993 | Yamamoto et al. | 401/99 X |
| 5,186,562 | 2/1993 | Yoshinaga et al. | 401/112 |
| 5,735,592 | 4/1998 | Shu | 401/195 X |

FOREIGN PATENT DOCUMENTS

| | | | |
|---|---|---|---|
| 47379 | 3/1982 | European Pat. Off. | 401/195 |
| 92/13725 | 8/1992 | European Pat. Off. | 401/52 |
| 2533106 | 2/1976 | Germany | 401/109 |
| 786107 | 11/1957 | United Kingdom | 401/112 |

*Primary Examiner*—David J. Walczak
*Assistant Examiner*—Kathleen J. Prunner
*Attorney, Agent, or Firm*—Rosenberg, Klein & Bilker

[57] ABSTRACT

A pen possible to sound includes a housing, an ink holder, a fit member, a gear set, and an operative member combined together. An elastic strip is provided in an intermediate portion of the housing, and the ink holder is movably located in a lower portion of the housing. An operative member is positioned in and on the outer surface of the housing, having a rack engaging a pinion of a main gear of the gear set. If the operative member is repeatedly pushed down, the elastic strip is snapped by an eccentric gear of the gear set, giving out sounds.

8 Claims, 6 Drawing Sheets

PEN POSSIBLE TO SOUND

BACKGROUND OF THE INVENTION

This invention relates to a pen possible to sound, particularly to one sounding out interesting sounds by repeatedly pushing a push block provided in a pen.

So far, pens possible to give out sounds have not been available in market.

SUMMARY OF THE INVENTION

This invention has been devised to offer a kind of pen possible to sound for consumers to choose.

A main feature of the invention is an elastic strip provided in the housing to be snapped to sound by an eccentric gear of the gear set when an operative member located in and on an outer surface of a housing is pushed down to move a ball point end of a ink holder out of the housing for writing.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
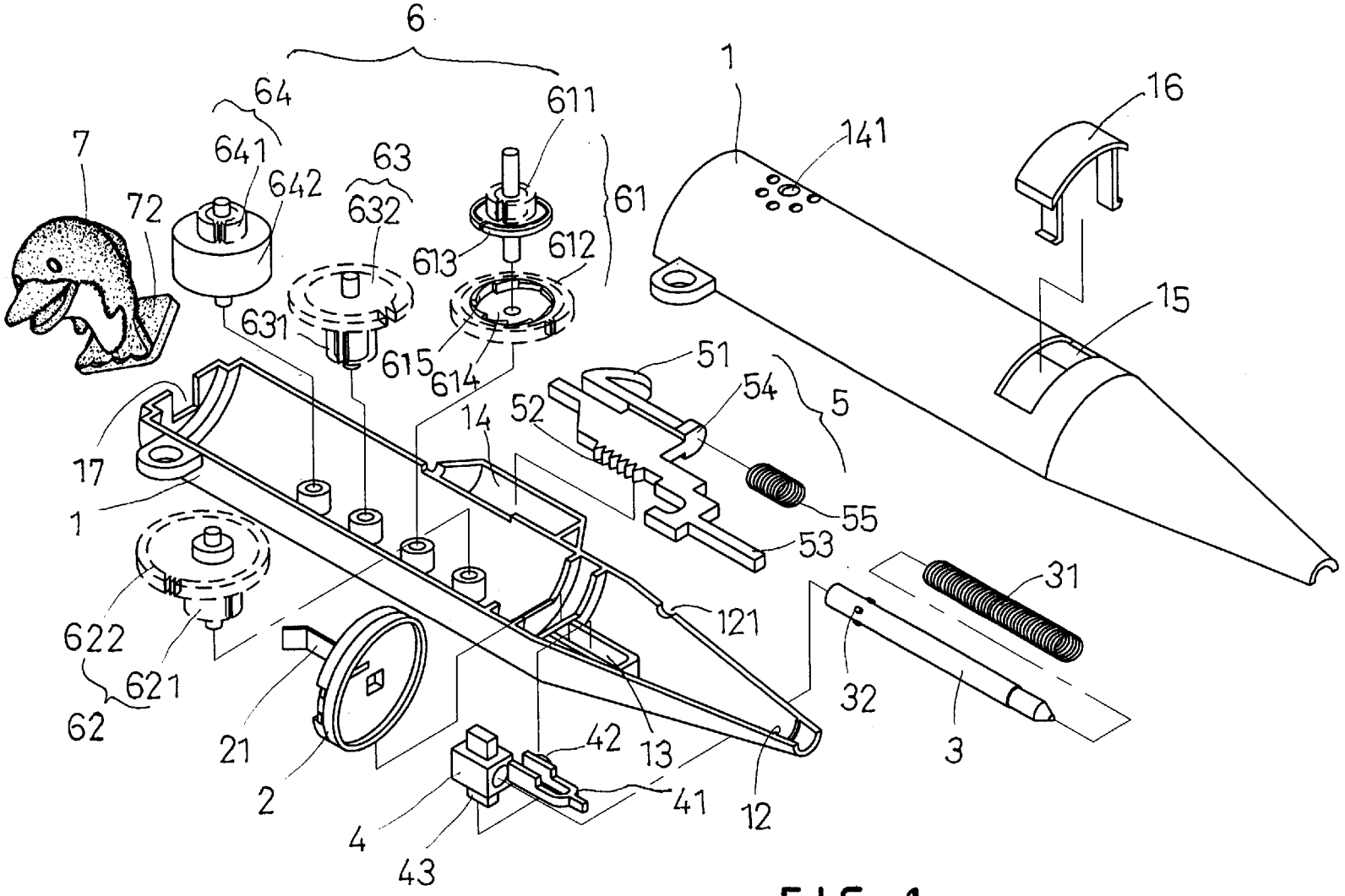
FIG. 1 is an exploded perspective view of a pen possible to sound of the present invention.

A pen possible to sound in the present invention, as shown in FIG. 1, includes a housing 1, a securing member 2, a pin holder 3, a fit member 4, an operative member 5, a gear set 6 and a decorative head 7 as components combined together.

The housing 1 consists of two half housings respectively having a securing groove 11 in an intermediate portion for disposing the securing member 2 therein, a lower half portion for the ink holder 3 to position therein. The housing 1 further has plural small sound holes 141 formed in the upper portion, and an adjust hole 15 formed in an intermediate portion near an elastic strip 21 for adjusting the curvature of the elastic strip 21, and a cap 16 provided to close the adjust hole 15.

The securing member 2 has a circular shape, and the elastic strip 21 is formed to extend to the left side from the circular body.

The ink holder 3 is surrounded by a long coil spring 31, which has two ends respectively hooking with a small projection 32 on an outer surface of the ink holder 3 and a small recess 12 in an inner side of the housing 1. The ink holder 3 has its upper end fitting in the fit member 4, and a ball point lower end to be moved out of the housing 1 for writing.

The fit member 4 has an elastic U-shaped portion 41, and a stud 42 is provided on an outer side of the elastic U-shaped portion 41 to engage or disengage from a fit hole 121 provided in the lower portion of the housing 1. Further, the fit member 4 has a guide portion 43 respectively on an upper surface and a lower surface to fit and move in two opposite guide grooves 13 provided inside the lower portion of the housing 1.

The operative member 5 is movably combined in and on the wall of the housing 1, having a push member 51 extending out of the wall of the housing 1, a rack 52 formed in an inner side, an elongate member 53 formed to extend to the right side from the rack 52 and to protrude through the securing member 2, contacting and able to push the fit member 4 and the ink holder 3 together, and a press member 54 formed at one end for contacting an end of a coil spring 55 located in a compartment 14 formed on an outer surface of the housing 1.

The gear set 6 includes a main gear 61, a subordinate gear 62, a transmitting gear 63, and a power gear 64, which are all pivotally contained in the upper portion of the housing 1.

The main gear 61 consists of a pinion 611 and a large gear 612 respectively at two, an upper and a lower sides, with the pinion 611 engaging the rack 52 of the operative member 5.

The subordinate gear 62 consists of a pinion 621 and an eccentric gear 622 respectively at two, an upper and a lower, sides. The pinion 621 engages the large gear 612 of the main gear 61, and the eccentric gear 622 rotates to snap the elastic strip 21 of the securing member 2 to give out sounds.

The transmitting gear 63 consists of a pinion 631 and a large gear 632 respectively at two sides. The pinion 631 engages the large gear 612 of the main gear 61.

The power gear 64 consists of a pinion 641 and a weight 642 respectively at two sides. The pinion 641 engages the large gear 632 of the transmitting gear 63 and the weight 642 supplying an inertia force to the power gear 64 to help the subordinate gear to rotate with stronger inertia force to snap the elastic strip 21 for a longer period of time than otherwise.

The decorative head 7 is combined with an upper end of the housing 1, having a post portion 71 and a plate portion 72 formed under the post portion 71, with the post portion 71 engaging a hole 17 in an upper end surface of the housing 1.

Figure 6:
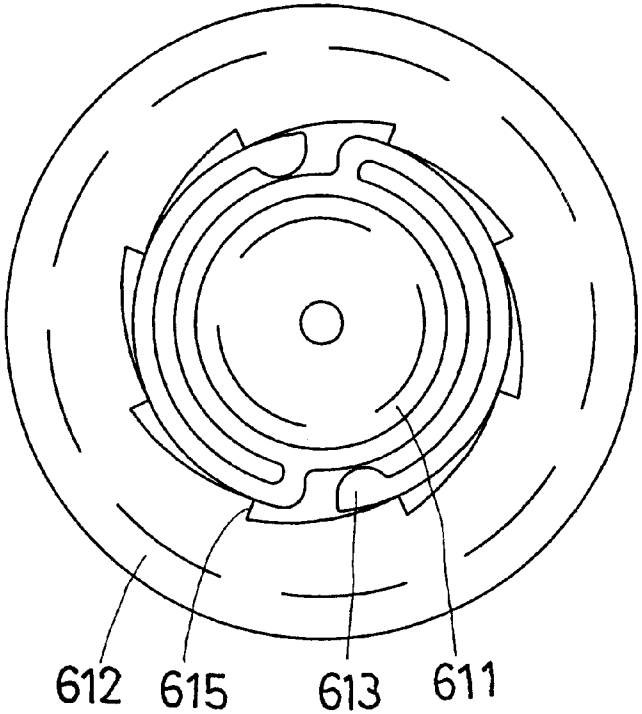
FIG. 6 is a side view of the large gear of the main gear not engaging the pinion of the main wheel in the present invention.
Figure 5:
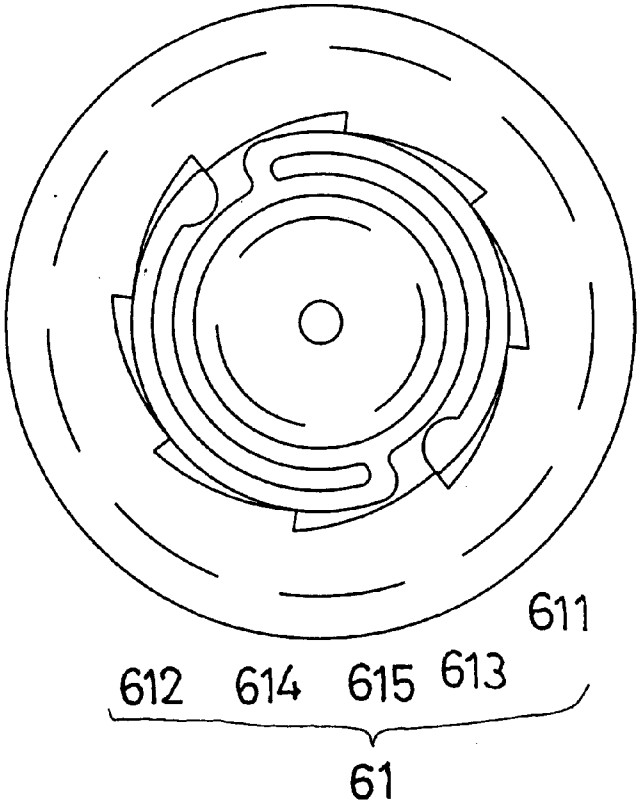
FIG. 5 is a side view of a large gear of a main gear engaging a pinion of the main gear in the present invention.
Figure 7:
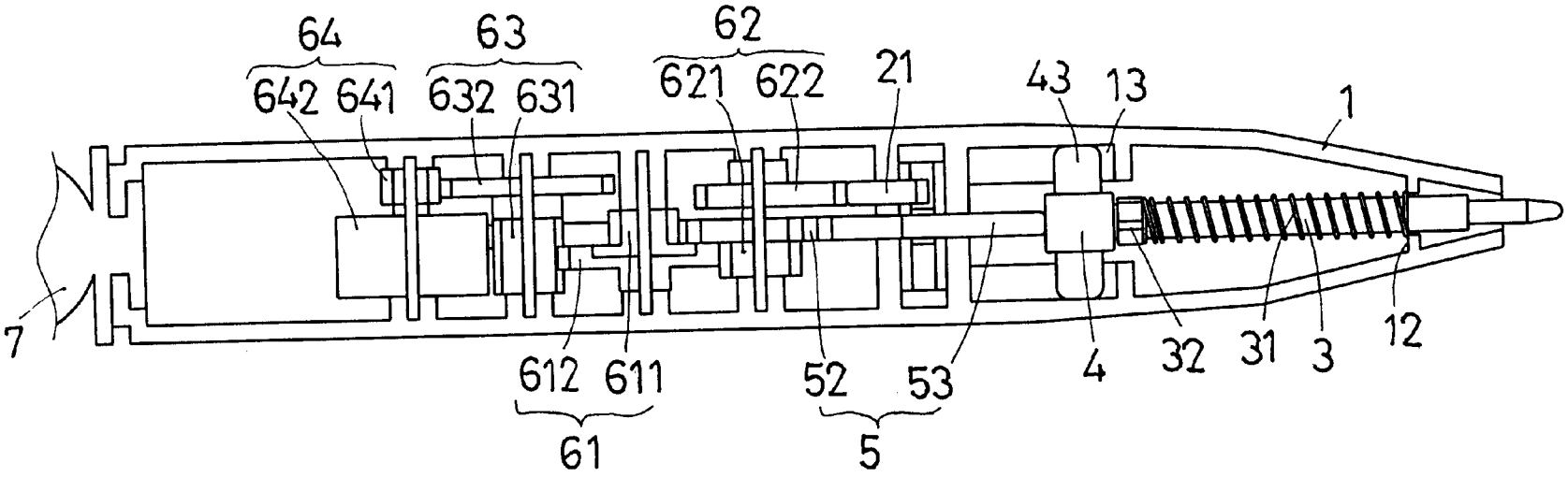
FIG. 7 is a side cross-sectional view of the operative member pressed down in the pen possible to sound in the present invention.

Referring to FIGS. 1 and 5, the pinion 611 of the main gear 61 has ratchet teeth 613 formed on its periphery and the large gear 612 has a recess 614 and a plurality of ratchet teeth 615, and the ratchet teeth 613 will engage the ratchet teeth 615 when the pinion is rotated clockwise, and subsequently the pinion 611 rotates the large gear 612. On the contrary, if the pinion 611 is rotated counterclockwise, as shown in FIG. 6, the ratchet teeth 613 cannot engage the ratchet teeth 615 so that the large gear rotates only clockwise.

Now, referring to FIGS. 1, 3, 4 and 7, in use, the push portion 51 of the operative member 5 is pushed down, forcing the press portion 54 to compress the coil spring 55 and compel the elongate portion 53 to move down to press and move down the fit block 4. Then the fit block 4 slides down, guided by the guiding portion 43 and the guide grooves 13, forcing the stud 42 to engage the hole 121, keeping a lower end (a ball point) of the ink holder 3 protruding out of the housing 1. Further, the downward movement of the operative member 5 also forces the rack 52 to rotate the main gear 61, which then in order rotates the subordinate gear 62, the transmitting gear 63 and the power gear 64. So the eccentric gear 622 rotates to snap intermittently the elastic strip 21 to produce intermittent and light-and-heavy sounds. As the power gear 64 has a weight 642, it will rotate with strong inertia force once it begins to rotate, further helping to rotate the transmitting gear 63, the main gear 61 and the subordinate gear 62 to continue rotating for a longer period than otherwise to snap the elastic strip 21 by the eccentric gear 622 for sounding.

Figure 2:
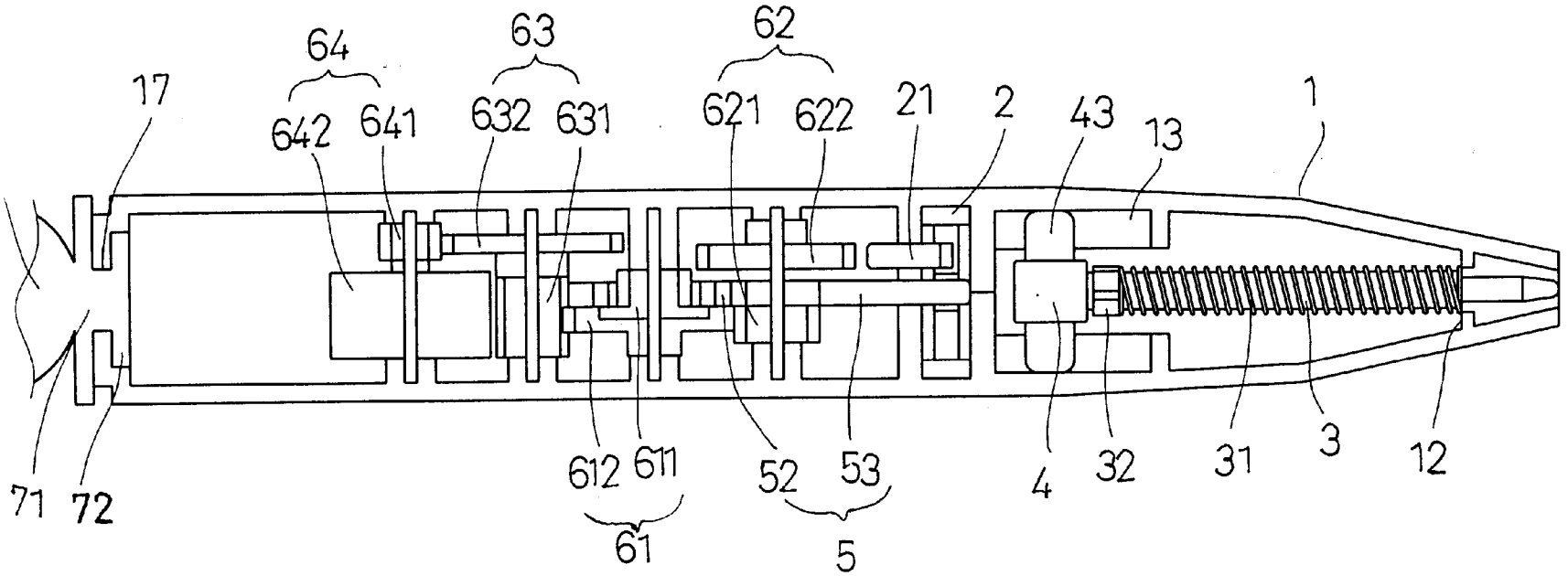
FIG. 2 is a cross-sectional view of the pen possible to sound of the present invention.
Figure 9:
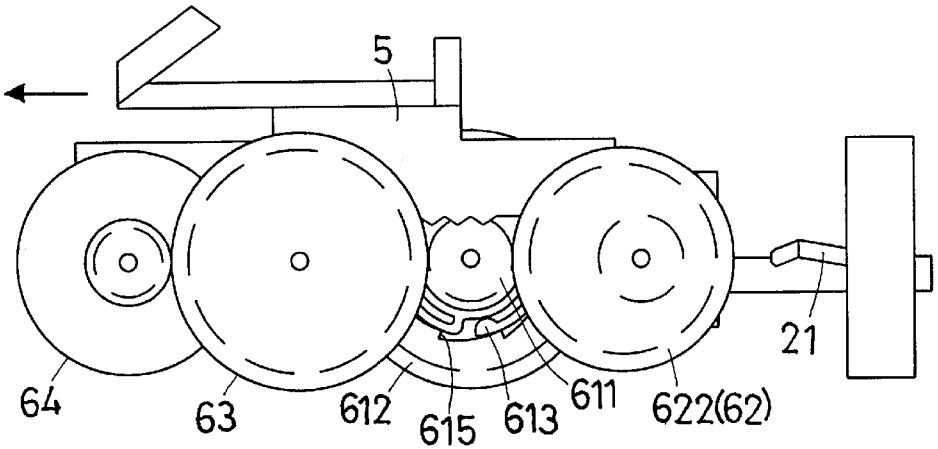
Figure 4:
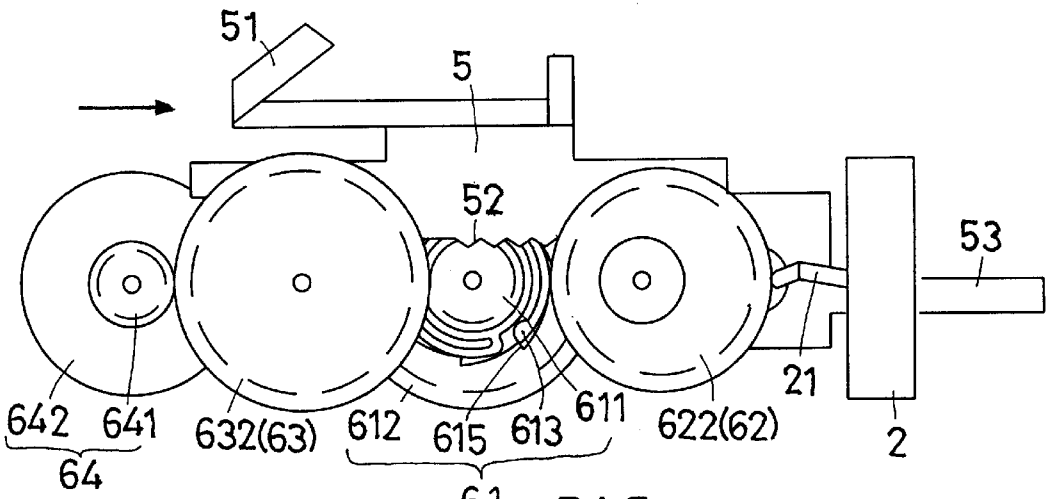
FIG. 4 is a side view of an operative member combined with a gear set and the operative direction showed in the present invention.

Further, the engaging structure of the pinion 611 and the large gear 612 can let the pinion 611 rotate clockwise by the rack 52 whenever the operating member 5 is pressed down, and the ratchet teeth 613 engage the ratchet 615, enabling the large gear 612 to rotate the subordinate gear 62 and the transmitting gear 63. Next, referring to FIGS. 2 and 9, if the operating member 5 is released, it will be moved and lifted up by the coil spring 31 so far compressed recovering its resiliency. Then the rack 52 rotates the pinion 611 conterclockwise, unable to engage the ratchet teeth 615 so that the large large gear 612 rotates only clockwise. In addition, the large gear 612 also receives large inertia force from the power gear 64 and the transmitting gear 63 to enable the subordinate gear 62 to rotate longer than otherwise. Thus, if the operating member 5 is pressed repeatedly, the elastic strip 21 is continued to be snapped to give out sounds.

Figure 3:
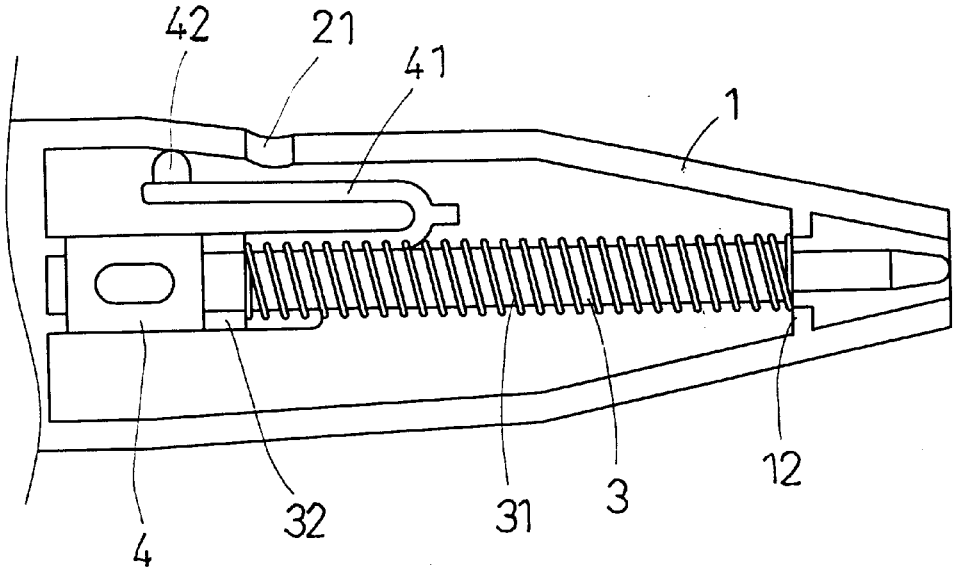
FIG. 3 is a partial cross-sectional view of the pen possible to sound, with a ink holder not moved out of a housing, of the present invention.
Figure 8:
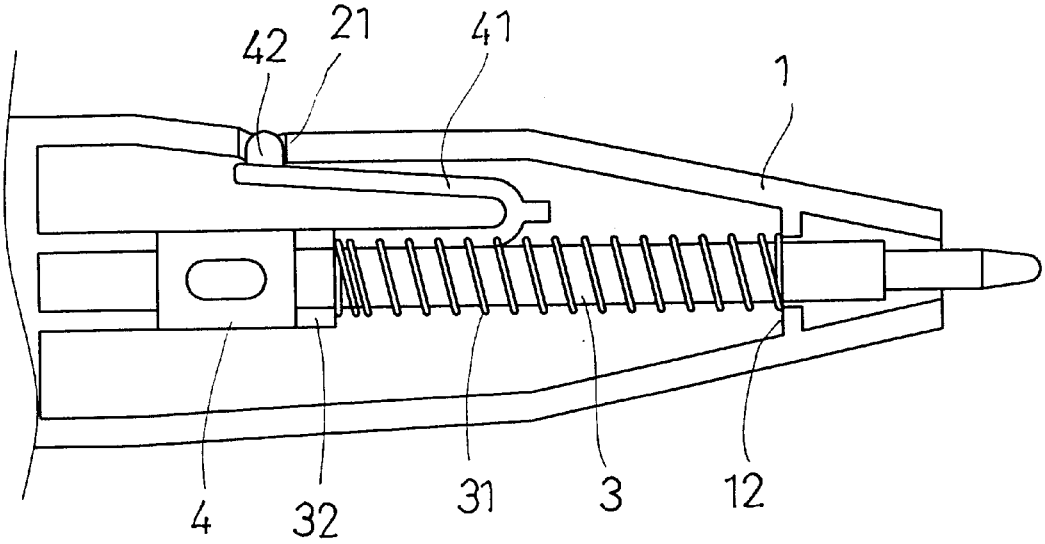
FIG. 8 is a partial cross-sectional view of the pen, with the ink holder extending out of the housing in the present invention; and, FIG. 9 is a side view of the operative member released to move back and up to an original position in the present invention.

If the pen is not used for writing, as shown in FIGS. 3 and 8, the stud 42 is pressed to disengage from the hole 121 to shrink inside the housing 1, with the coil spring 31 elastically pushing back the ink holder 3 in the housing 1.

When the elastic plate 21 gives out sounds not satisfactory, a user can take off the cap 16 and adjust with a tool the elastic plate 21 in its curvature and angle. Thus sounding time and quality of the elastic plate 21 can be altered.

As can be understood from the aforesaid description, the pen in the invention has the following advantages.

1. It can be used for writing, and at the same time for giving out sounds to attract curiosity of a user.

2. Sounding function can attract children's curiosity in writing.

3. The decorative head may be shaped as a dolphin, a crow, a dog, etc, and the sounds given out by the elastic plate 21 may be thought to be those of the animal the head represents.

4. The sounds given out by the elastic strip 21 may be altered by adjusting it.

While the preferred embodiment of the invention has been described above, it will be recognized and understood that various modifications may be made therein and the appended claims are intended to cover all such modifications which may fall within the spirit and scope of the invention.

What is claimed is:

1. A pen possible to sound comprising a housing, an ink holder, a fit member, a gear set, and an operative member as components combined together;

said housing consisting of two half housings combined tightly together, having an intermediate portion in which an elastic strip is located;

said ink holder having a ball point at a lower end for writing, positioned in a lower portion of said housing, surrounded by a coil spring, said coil spring having one end hooking a projection on said ink holder and the other end hooking a groove of said housing, an end of said ink holder fitting in said fit member;

said fit member having a U-shaped elastic portion, a stud provided on an outer side of said elastic portion to engage or disengage from a hole provided in said housing;

said operative member having a push portion located on an outer surface of said housing, a rack on an inner side, an elongate member extending toward the lower portion of the housing from said rack and contacting and able to push said fit member downward, a press portion provided on one end to push one end of a coil spring disposed in a compartment formed on the outer surface of said housing; and said gear set contained in an upper portion of said housing, consisting of a main gear, a subordinate gear, said main gear consisting of a pinion engaging said rack of said operative member and a large gear, said subordinate gear consisting of a pinion engaging said large gear of said main gear and an eccentric gear engaging said elastic strip; whereby said operative member is pressed down to project said ball point so that a tip is disposed outside of said housing and to rotate said main gear which then rotates said subordinate gear to let said eccentric gear rotate to snap said elastic strip, which then gives out sounds.

2. The pen possible to sound as claimed in claim 1, wherein said housing has a securing groove formed in the intermediate portion, a round securing member is provided to fit in said securing groove, said elastic strip is fixed on one side of said securing member, and said elongate member of said operative member protrudes through said securing member.

3. The pen possible to sound as claimed in claim 1, wherein said fit member has a guide portion formed respectively on an upper side and a lower side to fit in a guide groove formed oppositely in the housing.

4. The pen possible to sound as claimed in claim 1, wherein said said gear set further includes a transmitting gear and a power gear, said transmitting gear consists of a pinion engaging said large gear of said main gear and a large gear, and said power gear consists of a pinion engaging said large gear of said transmitting gear and a weight.

5. The pen possible to sound as claimed in claim 1 or 4, wherein said pinion of said main gear and said large gear respectively have an engage structure, wherein said pinion has elastic curved ratchet teeth and said large gear has a recess in a side and a plurality of ratchet teeth formed around said recess, said elastic curved ratchet teeth of said pinion engage with said ratchet teeth of said large gear when said pinion is rotated clockwise, said elastic curved ratchet teeth of said pinion cannot engage said ratchet teeth of said large gear when said pinion is rotated counterclockwise so that said large gear rotates only clockwise.

6. The pen possible to sound as claimed in claim 1, wherein said housing has several small sound holes spaced apart in a proper location.

7. The pen possible to sound as claimed in claim 1, wherein said housing further has an adjust hole near said elastic strip for adjusting the curvature of said elastic strip, and a cap is provided to close said adjust hole.

8. The pen possible to sound as claimed in claim 1, wherein said housing further has its upper end fixed with a decorative head, having a post portion and a large plate portion under said post portion, and said post portion engages tightly a hole in the upper end of said housing.

* * * * *